United States Patent [19]

Papa et al.

[11] Patent Number: 4,881,902

[45] Date of Patent: Nov. 21, 1989

[54] ELECTRICAL TERMINATOR DEVICE

[75] Inventors: Ralph A. Papa, Susquehanna Twp., Susquehanna County; James R. Koser, Elizabethtown, both of Pa.

[73] Assignee: E. I. du Pont de Nemours and Company, Wilmington, Del.

[21] Appl. No.: 135,532

[22] Filed: Dec. 17, 1987

Related U.S. Application Data

[63] Continuation of Ser. No. 914,551, Oct. 1, 1986, abandoned, which is a continuation of Ser. No. 727,918, Apr. 29, 1985, abandoned, which is a continuation-in-part of Ser. No. 653,381, Sep. 21, 1984, Pat. No. 4,585,284.

[51] Int. Cl.[4] ..... H01R 13/66

[52] U.S. Cl. ..... 439/76; 333/22 R

[58] Field of Search ..... 339/17 R, 17 C, 17 CF, 339/147 R, 147 P, 193 P; 338/306-311; 361/414, 393-396; 439/620, 76; 333/181-185, 22 R

[56] References Cited

U.S. PATENT DOCUMENTS

| | | | |
|---|---|---|---|
| 3,208,030 | 9/1965 | Evans et al. | 339/47 |
| 3,234,433 | 2/1966 | Braunagel | 339/17 N |
| 3,391,384 | 7/1968 | Hughes | 339/17 C |
| 3,411,947 | 11/1968 | Block | 338/309 |
| 3,551,874 | 12/1970 | Volinskie | 339/17 C |
| 3,617,811 | 11/1971 | McVoy | 174/59 |
| 3,745,508 | 7/1973 | Bruder et al. | 338/309 |
| 3,951,490 | 4/1976 | Devendorf | 439/76 |
| 3,964,087 | 6/1976 | Mallon | 338/308 |
| 4,004,196 | 1/1977 | Doucet | 361/414 |
| 4,105,275 | 8/1978 | Dixon et al. | 339/91 R |
| 4,331,370 | 5/1982 | Andrews et al. | 339/17 M |
| 4,389,021 | 6/1983 | Coldren | 339/126 R |
| 4,401,351 | 8/1983 | Record | 439/61 |
| 4,440,463 | 4/1984 | Gliha, Jr. et al. | 339/14 R |
| 4,506,937 | 3/1985 | Cosmos et al. | 339/14 R |
| 4,516,816 | 5/1985 | Winthrop | 339/17 C |
| 4,585,284 | 4/1986 | Koser et al. | 439/77 |

FOREIGN PATENT DOCUMENTS

| | | |
|---|---|---|
| 0130844 | 1/1985 | European Pat. Off. . |
| 1367183 | 6/1964 | France . |
| 1491008 | 6/1967 | France . |
| 83/03717 | 10/1983 | PCT Int'l Appl. . |
| 1397249 | 6/1975 | United Kingdom . |
| 2130818 | 6/1984 | United Kingdom . |

OTHER PUBLICATIONS

IBM Bulletin, Falda, vol. 23, No. 12, p. 5410, 5-1981.
Sperry-Univac Engineering Drawing No. 3624997, "I/O Cable Adapter Assy.", Nov. 1981.
Bulletin 2000, Berg/Serpent Connector, 9/80.
Data Sheet 2317, Berg Serpent I/O Adapter, 2/84.

*Primary Examiner*—Neil Abrams
*Attorney, Agent, or Firm*—Jeffrey H. Ingerman

[57] ABSTRACT

A compact electrical terminator device is provided. The device has a circuit board mounted parallel to the mating face of the device between two housings. The resistive or other impedance elements are mounted on the side of the circuit board away from the mating face and are covered by a ventilated housing. The terminals of the device project directly from the circuit board in the other direction, passing through terminal channels in the other housing.

20 Claims, 4 Drawing Sheets

ELECTRICAL TERMINATOR DEVICE

CROSS REFERENCE TO RELATED APPLICATIONS

This application is a continuation of co-pending U.S. patent application Ser. No. 914,551, filed Oct. 1, 1986, now abandoned, which was a continuation of U.S. patent application Ser. No. 727,918, filed Apr. 29, 1985, now abandoned, which was a continuation-in-part of U.S. patent application Ser. No. 653,381, filed Sept. 21, 1984, now U.S. Pat. No. 4,585,284.

BACKGROUND OF THE INVENTION

This invention relates to electrical connectors, and particularly to an electrical terminator device for terminating an open signal path of an electronic device. More particularly, this invention relates to a terminator for input/output interfaces of electronic digital computers.

Electronic digital computers are typically equipped with a plurality of input/output interface ports. In most cases, each port is a standard array of terminals to which any one of a number of peripheral devices—e.g., printers, card readers, disk drives, optical character readers, video display terminals, and modems or other devices for communicating with other computers—can be connected. Many of these peripheral devices are optional, and their absence will not affect the operation of the computer. In fact, large computers are generally provided with large numbers of input/output ports and many remain unused.

Of these ports, some may be dedicated to particular essential peripheral devices. If one of these devices is absent, it may be desirable for the computer to shut down automatically, or to automatically start or stop selected functions. Even if a port is not dedicated, it may be desirable to have some means for informing the central processing unit that it need not search for any input/output devices at that port. At the very least, it is desirable to cover unused ports to keep out dust, and to prevent accidental short circuits or physical terminal damage.

Simple covers which prevent short circuits and physical damage are well known. It is also known to provide terminator devices which indicate to the central processing unit that a port is unused or that is should shut down some or all functions or start some functions. Known terminator devices include a circuit board having impedance elements. The impedance elements are arranged to provide the appropriate information to the central processing unit, whether by matching the characteristic impedance of the input/output port or by presenting some other preselected impedance or impedances to the port or to selected terminals in the port.

The impedance elements on the circuit board must be connected to terminals which can be mated with those of the input/output port. In known terminator devices, the connections are made by providing a plurality of socket terminals on the edge of the circuit board. The terminals are designed to receive straight pins parallel to the surface of the board on which the impedance elements are located. Because many computer input/output ports are not composed of straight pins in the same configuration, it is necessary to interpose an adapter of which one end plugs into the terminals on the edge of the circuit board and which presents on its other end a set of terminals which is "plug-compatible" with the computer in question. The adapter can be separate from the terminator, or it could be built into the same housing as the circuit board. Because a circuit board having such terminals plugs into the port edge-on, it protrudes a relatively large distance from the panel in which the port is located. This is so even if no adapter is necessary. In this position, it could present a hazard to those passing by, and it is susceptible to being damaged or knocked off if struck, because of the relatively larger torque that can be applied. It would be desirable to have terminators protrude as little as possible from the computer panel.

In addition, because of the positioning of the circuit board, the lines on the circuit board are relatively long. It would be desirable to shorten them to reduce signal delay time and power dissipation.

SUMMARY OF THE INVENTION

It is therefore an object of this invention to provide an electrical terminator device that does not project significantly from the input/output interface panel to which it is connected.

It is another object of this invention to provide such a terminator device which is compact in size.

It is a further object of this invention to provide such a terminator in which the signal paths are as short as possible.

In accordance with this invention, an electrical device is provided comprising a circuit board having first and second sides and a plurality of through holes, and having signal leads on at least one side in electrical contact with said plurality of through holes. A plurality of electrical terminals, each of said terminals having first and second contact ends, are each mounted on said first side of said circuit board in a respective one of said plurality of through holes in electrical contact therewith at said first contact end. The terminals extend substantially perpendicularly from said circuit board and substantially parallel to one another. A plurality of impedance elements are mounted on said second side of said circuit board. Each of said impedance elements is mounted in electrical contact with at least two of said plurality of through holes. A first dielectric housing having multiple terminal receiving channels mates with said second contact ends of said terminals on said first side of said circuit board. A second dielectric housing covers said impedance elements on said second side of said circuit board. Means are provided for retaining said first dielectric housing, said circuit board, and said second dielectric housing in assembled relationship, whereby said second ends of said terminals project from said terminal receiving channels in said first dielectric housing for connection to a further electrical device, a selected impedance being observable between any two selected ones of said terminals.

BRIEF DESCRIPTION OF THE DRAWINGS

The above and other objects and advantages of the invention will be apparent after consideration of the following detailed description, taken in conjunction with the accompanying drawings, in which like reference characters represent like parts throughout and in which.

DETAILED DESCRIPTION OF THE INVENTION

The present invention can be used to provide line terminator devices for any type of electronic or data processing equipment. Terminator devices according to the invention can be made with any type of terminal configuration. For example, a terminator can be provided which mates with a D-subminiature connector of the type commonly used in military electronics.

Figure 1:
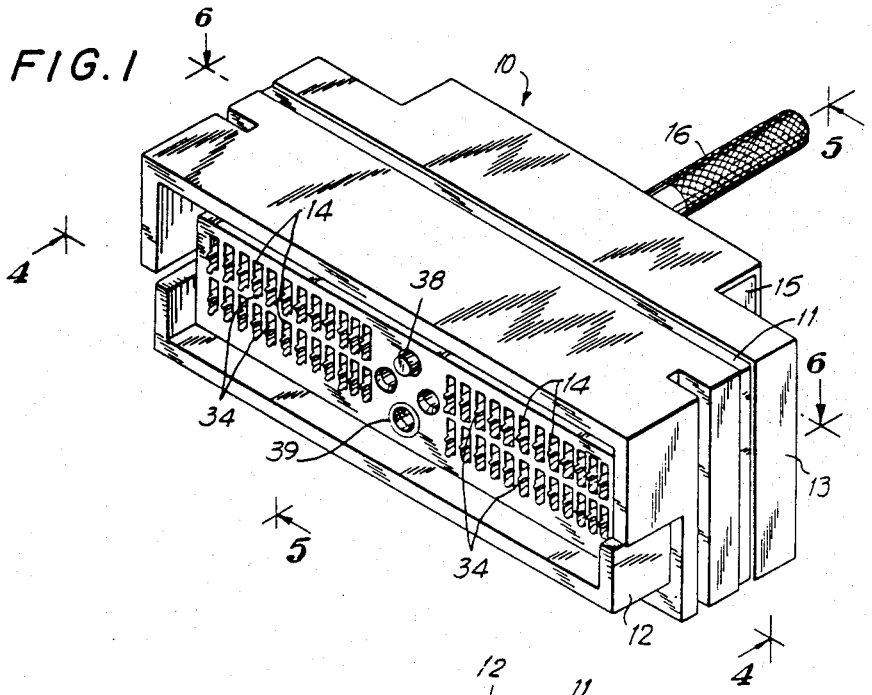
FIG. 1 is a perspective view of the device of the invention as seen from the mating end.
Figure 2:
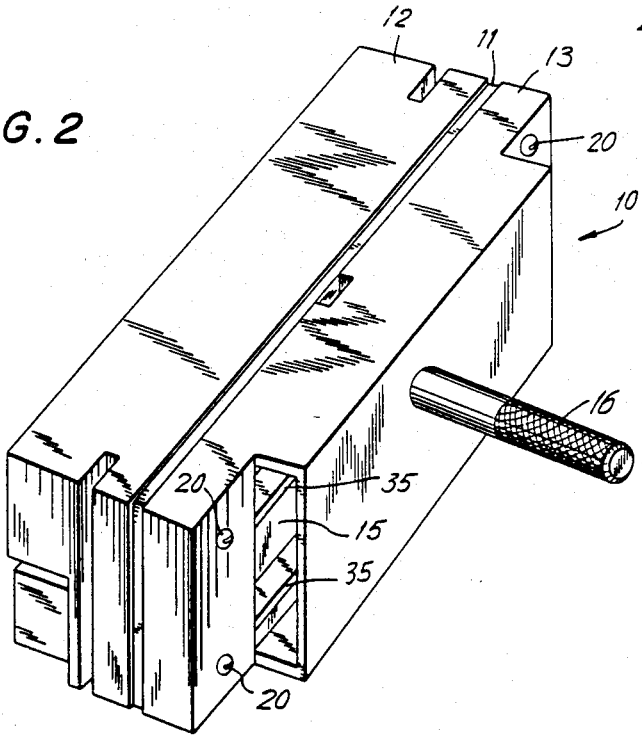
FIG. 2 is a perspective view of the device of the invention as seen from the covered end.
Figure 3:
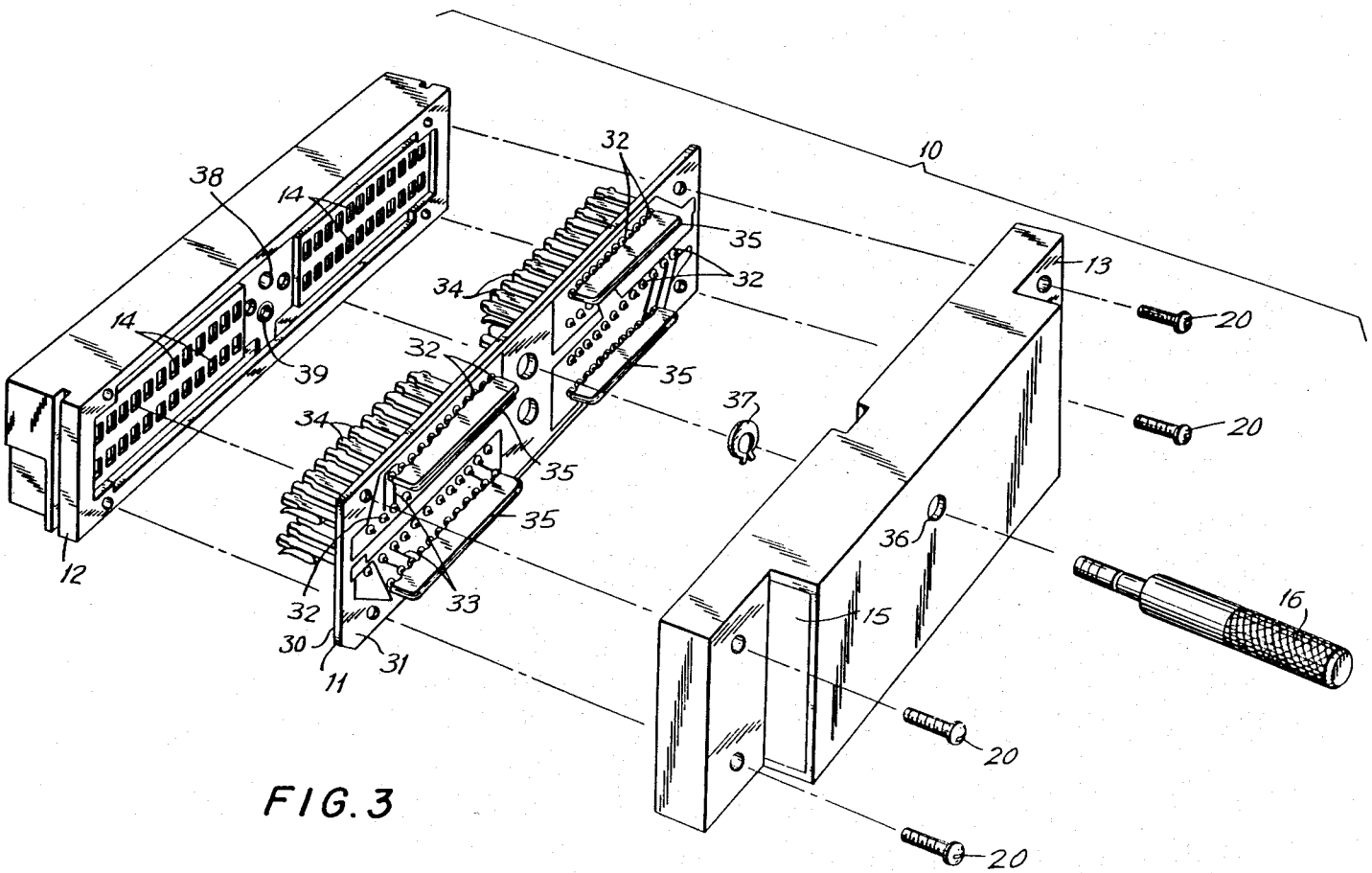
FIG. 3 is an exploded perspective view of the device of the invention as seen from the covered end.
Figure 4:
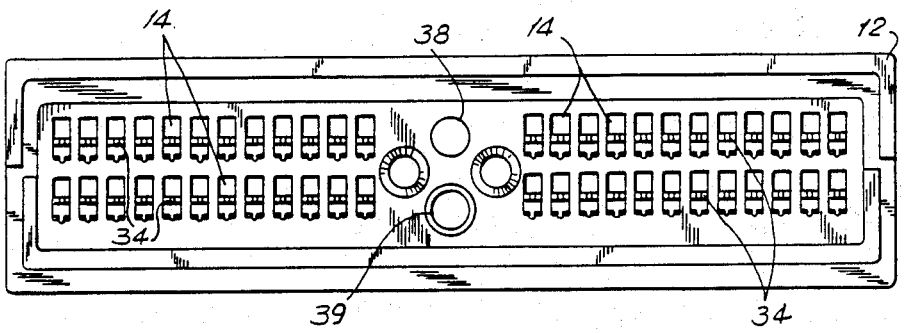
FIG. 4 is an elevational view of the device of the invention taken from line 4—4 of FIG. 1.
Figure 5:
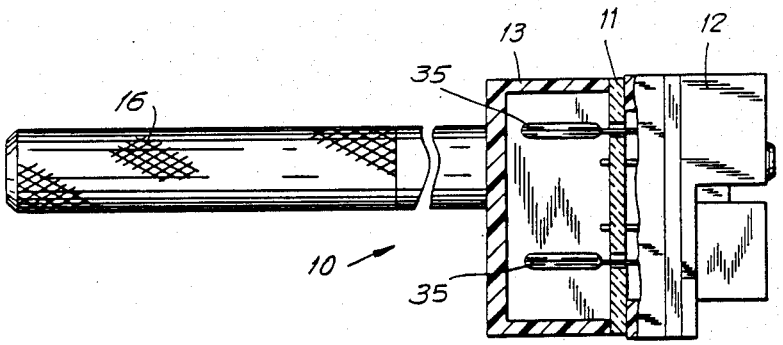
FIG. 5 is a cross-sectional view of the device of the invention taken from line 5—5 of FIG. 1.
Figure 6:
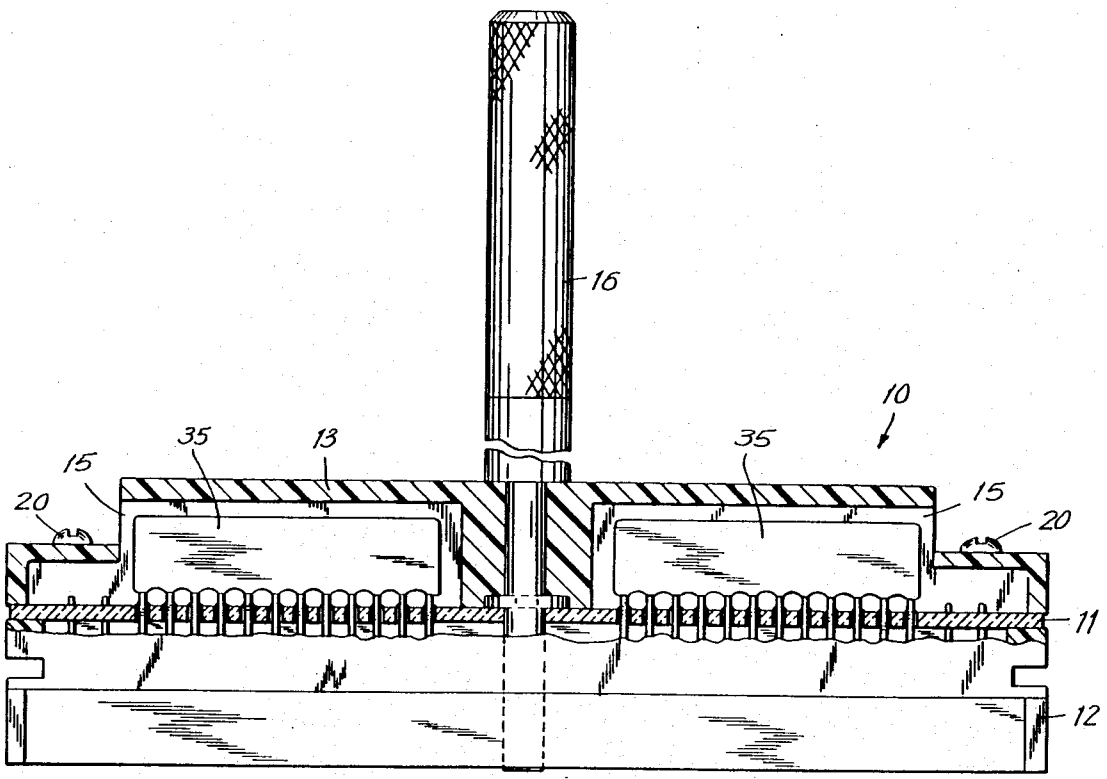
FIG. 6 is a cross-sectional view of the device of the invention taken from line 6—6 of FIG. 1.

A preferred embodiment of the invention which is compatible with the 360/370 series of electronic digital computers produced by the International Business Machines Corporation (IBM), and with other IBM products, is shown in FIGS. 1–6. This embodiment is provided with an array of serpent terminals on 0.125 inch by 0.250 inch centers.

Terminator 10 includes circuit board 11 sandwiched between first dielectric housing 12 and second dielectric housing 13. Circuit board 11 is preferably made from copper clad glass fiber base epoxy resin. Dielectric housing 12 is preferably made from unfilled polycarbonate with a flammability rating of 94V-0. Dielectric housing 13 is preferably made from a thermoplastic material with a flammability rating of 94V-0.

Circuit board 11 has a first side 30 and a second side 31, and a plurality of through holes 32. Signal leads 33 are in electrical contact with through holes 32. A plurality of serpent terminals 34 are mounted on first side 30 of circuit board 11. A first contact end of each terminal 34 is mounted in, and is in electrical contact with, a respective hole 32. Terminals 34 extend substantially perpendicularly from circuit board 11 substantially parallel to one another.

Four resistor networks 35, each equivalent to six resistors, are each mounted on circuit board 11 in electrical contact with twelve of the holes 32. Resistor networks 35, together with signal leads 33, present selected resistances between the various terminals 34. These resistances can be selected, by choosing resistor networks 35 and the arrangement of signal leads 33, to create a terminator 10 which will "tell" a computer, with an input/output port of which it is mated, that there is no device in the port, that it should shut down if the particular port in question is accessed, or that it should turn on, or any other "message" of which one skilled in the art might conceive. Other types of resistor networks or individual resistors or other types of impedance elements could also be used.

First dielectric housing 12 has a plurality of terminal receiving channels 14, one for each terminal 34. Second dielectric housing 13 covers resistor networks 35 and signal leads 33, and has ventilation openings 15 for dissipation of the heat produced by resistor networks 35. Housings 12, 13 and circuit board 11 are held together by four self-tapping screws 20.

Preferably, a jack screw 16 is provided to fix terminator 10 to the connector to which it is mated. Jack screw 16, knurled to provide a frictional surface for twisting, is attached to second housing 13 through hole 36 by a C-clip 37, which allows jack screw 16 to rotate while preventing its longitudinal withdrawal from housing 13. Jack screw 16 passes through holes 38 in circuit board 11 and first housing 12 for engagement with a threaded hole in the mating connector. A threaded insert is provided in hole 39 in first housing 12 to receive a screw, if any, from the mating connectors.

By using resistor networks 35 in conjunction with signal leads 33 on a circuit board 11 mounted parallel to the mating face of terminator 10 as described above, it is thereby possible to create a terminator which is much more compact than those previously known, and which will project less from the device to which it is mated.

It will be apparent to one skilled in the art that the invention principles disclosed herein can be practiced by other than the embodiment described, which is presented for the purposes of illustration rather than limitation, and the present invention is limited only by the claims which follow.

What is claimed is:

1. An electrical device for terminating an input/output port in electronic equipment, said electrical device comprising:

a circuit board having first and second sides and a plurality of through holes, and having signal leads on at least one side in electrical contact with said plurality of through holes;

a plurality of electrical terminals, each of said terminals being a hermaphroditic serpent terminal having first and second contact ends, each of said terminals being mounted on said first side of said circuit board in a respective one of said plurality of through holes in electrical contact therewith at said first contact end, said terminals extending substantially perpendicularly from said circuit board and substantially parallel to one another;

a plurality of impedance elements mounted on said second side of said circuit board, each of said impedance elements being mounted in electrical contact with at least two of said plurality of through holes;

a first dielectric housing having multiple terminal receiving channels, said first housing presenting a mating face to said input/output port, said mating face being parallel to said circuit board, each of said serpent terminals being free of means for latching into said channels, said plurality of serpent terminals being simultaneously insertable into, and simultaneously removable from, said channels;

a second dielectric housing for covering said impedance elements on said second side of said circuit board; and means for retaining said first dielectric housing, said circuit board, and said second dielectric housing in assembled, sandwiched relationship;

whereby said second ends of said terminals project from said terminal receiving channels in said first dielectric housing for connection to said input/output port, a selected impedance being observable between any two selected ones of said terminals for altering the relationship between said port and said electronic equipment.

2. The electrical device according to claim 1 wherein said impedance elements are resistive elements, and said selected impedances are selected resistances.

3. The electrical device according to claim 2 wherein said resistive elements are resistor networks having a plurality of network terminals.

4. The electrical device according to claim 3 wherein each of said resistor networks has twelve of said network terminals and is equivalent to six resistors.

5. The electrical device according to claim 4 comprising four of said resistor networks.

6. The electrical device according to claim 1 wherein said impedance elements are selected, and said signal leads are arranged, such that said selected impedances present a desired impedance to said second device.

7. The electrical device of claim 1 wherein each of said channels has, at an end adjacent said circuit board, a channel portion having a cross-sectional area that increases with decreasing distance from said circuit board for facilitating insertion of said plurality of serpent terminals.

8. An electrical termination device for terminating a signal path having first and second ends, having a characteristic impedance, and having an array of signal terminals at said second end, said electrical termination device comprising:

a circuit board having first and second sides and a plurality of through holes, and having signal leads on said second side in electrical contact with said plurality of through holes;

a plurality of electrical terminals, each of said electrical terminals being a hermaphroditic serpent terminal having first and second contact ends, each of said electrical terminals being mounted on said first side of said circuit board in a respective one of said plurality of through holes in electrical contact therewith at said first contact end, said electrical terminals extending substantially perpendicularly from said circuit board substantially parallel to one another in an array complementary to said array of signal terminals;

a plurality of impedance elements mounted on said second side of said circuit board, each of said impedance elements being mounted in electrical contact with at least two of said plurality of through holes;

a first dielectric housing having multiple terminal receiving channels mating with said second contact ends of said electrical terminals on said first side of said circuit board, each of said serpent terminals being free of means for latching into said channels, said plurality of serpent terminals being simultaneously insertable into, and simultaneously removable from, said channels;

a second dielectric housing for covering said impedance elements on said second side of said circuit board; and means for retaining said first dielectric housing, said circuit board, and said second dielectric housing in assembled, sandwiched relationship; wherein said impedance elements are selected, and said signal leads are arranged, such that said second ends of said electrical terminals present a desired impedance for altering the relationship between said first and second ends, thereby terminating such signal path.

9. The termination device according to claim 8 wherein said impedance elements are resistive elements.

10. The termination device according to claim 9 wherein said resistive elements are resistor networks having a plurality of network terminals.

11. The termination device according to claim 10 wherein each of said resistor networks has twelve of said network terminals and is equivalent to six resistors.

12. The termination device according to claim 11 comprising four of said resistor networks.

13. The termination device according to claim 8 wherein said desired impedance matches said characteristic impedance.

14. The electrical device of claim 8 wherein each of said channels has, at an end adjacent said circuit board, a channel portion having a cross-sectional area that increases with decreasing distance from said circuit board for facilitating insertion of said plurality of serpent terminals.

15. An electrical device for connection to an input/output port of a second device, said input/output port having a predetermined relationship with said second device, said electrical device comprising:

a connector portion; and a functional portion electrically connected to said connector portion; wherein said connector portion comprises:

a circuit board having first and second sides and a plurality of through holes, and having signal leads on said first side in electrical contact with said plurality of through holes, said functional portion being in electrical contact with said plurality of through holes on said second side of said circuit board;

a plurality of electrical terminals, each of said terminals being a hermaphroditic serpent terminal having first and second contact ends, each of said terminals being mounted on said first side of said circuit board in a respective one of said plurality of through holes in electrical contact therewith at said first contact end, said terminals extending substantially perpendicularly from said circuit board and substantially parallel to one another;

a dielectric housing having multiple terminal receiving channels, said housing presenting a mating face to said second device, said mating face being substantially parallel to said circuit board, each of said serpent terminals being free of means for latching into said channels, said plurality of serpent terminals being simultaneously insertable into, and simultaneously removable from, said channels; and means independent of said terminals for retaining said dielectric housing and said circuit board in assembled relationship; wherein said circuit board and said terminals thereon can be removed from said housing when desired by releasing only said terminal-independent retaining means.

16. The electrical device of claim 15 wherein said functional portion is a terminator portion for terminating said port, said terminator portion comprising impedance elements for altering the relationship between said port and said second device.

17. The electrical device of claim 15 wherein each of said channels has, at an end adjacent said circuit board, a channel portion having a cross-sectional area that increases with decreasing distance from said circuit board for facilitating insertion of said plurality of serpent terminals.

18. An electrical device for connection to an input/output port of a second device, said input/output port having a predetermined relationship with said second device, said electrical device comprising:

a connector portion; and a functional portion electrically connected to said connector portion; wherein said connector portion comprises:

a circuit board having first and second sides and a plurality of through holes, and having signal leads on said first side in electrical contact with said plurality of through holes, said functional portion being in electrical contact with said plurality of through holes on said second side of said circuit board;

a plurality of electrical terminals, each of said terminals being a hermaphroditic serpent terminal having first and second contact ends, each of said terminals being mounted on said first side of said circuit board in a respective one of said plurality of through holes in electrical contact therewith at said first contact end, said terminals extending substantially perpendicularly from said circuit board and substantially parallel to one another;

a dielectric housing having multiple terminal receiving channels, said housing presenting a mating face to said second device, said mating face being substantially parallel to said circuit board, each of said serpent terminals being free of means for latching into said channels, said plurality of serpent terminals being simultaneously insertable into, and simultaneously removable from, said channels; and means independent of said terminals for retaining said dielectric housing and said circuit board in assembled relationship, said terminal-independent retaining means being the sole means for retaining said dielectric housing and said circuit board in assembled relationship.

19. The electrical device of claim 18 wherein said functional portion is a terminator portion for terminating said port, said terminator portion comprising impedance elements for altering the relationship between said port and said second device.

20. The electrical device of claim 18 wherein each of said channels has, at an end adjacent said circuit board, a channel portion having a cross-sectional area that increases with decreasing distance from said circuit board for facilitating insertion of said plurality of serpent terminals.

* * * * *